US009791250B1

(12) United States Patent
Pestana

(10) Patent No.: US 9,791,250 B1
(45) Date of Patent: Oct. 17, 2017

(54) QUICK RELEASE CARRIER FOR AMMUNITION MAGAZINES

(71) Applicant: Alan D. Pestana, Deer Creek, WA (US)

(72) Inventor: Alan D. Pestana, Deer Creek, WA (US)

( * ) Notice: Subject to any disclaimer, the term of this patent is extended or adjusted under 35 U.S.C. 154(b) by 0 days.

(21) Appl. No.: 14/545,023

(22) Filed: Mar. 16, 2015

Related U.S. Application Data

(60) Provisional application No. 62/176,508, filed on Feb. 19, 2015.

(51) Int. Cl.
*F42B 39/02* (2006.01)

(52) U.S. Cl.
CPC ..... *F42B 39/02* (2013.01)

(58) Field of Classification Search
CPC .. F42B 39/02; F41A 9/65; F41A 17/38; Y10S 224/931
USPC ..... 224/191, 660
See application file for complete search history.

(56) References Cited

U.S. PATENT DOCUMENTS

| | | | | |
|---|---|---|---|---|
| 2,585,592 | A | 2/1952 | Sears | |
| 3,623,256 | A | 11/1971 | Shiplee, III | |
| 4,115,943 | A * | 9/1978 | Musgrave | F42B 39/02 42/71.01 |
| 4,120,109 | A | 10/1978 | Musgrave | |
| 4,484,404 | A | 11/1984 | Johnson | |
| 4,597,213 | A | 7/1986 | Musgrave | |
| 4,628,627 | A * | 12/1986 | Johnson | F41A 9/63 42/90 |
| 4,799,323 | A | 1/1989 | Musgrave | |
| 5,235,728 | A | 8/1993 | Nordberg | |
| 5,279,059 | A | 1/1994 | Howard | |
| 5,484,093 | A | 1/1996 | Hellweg et al. | |
| 5,636,465 | A * | 6/1997 | Johnson | F41A 9/68 42/50 |
| 6,000,589 | A | 12/1999 | Burdine | |
| 6,154,997 | A | 12/2000 | Aluotto et al. | |
| 6,202,908 | B1 | 3/2001 | Groover | |
| 6,327,805 | B1 | 12/2001 | Clifton, Jr. | |
| 6,644,488 | B1 | 11/2003 | Coleman | |
| 6,668,479 | B1 | 12/2003 | Obong | |
| 6,698,129 | B1 * | 3/2004 | Hanks | F41A 9/63 42/90 |
| 7,073,285 | B2 | 7/2006 | Obong | |
| 7,562,482 | B1 | 7/2009 | Johnson | |
| 8,104,640 | B2 | 1/2012 | Selvetti | |
| 8,104,656 | B1 | 1/2012 | George | |
| 8,151,503 | B2 | 4/2012 | Oz | |

(Continued)

*Primary Examiner* — Peter Helvey
(74) *Attorney, Agent, or Firm* — Todd N. Hathaway

(57) ABSTRACT

A carrier for spare ammunition magazines for rifles. The carrier includes a shell that receives the magazine, a latch mechanism that releasably retains the magazine in the shell, and a connector that attaches the carrier body to an article that is worn or that is carried by the user. The latch mechanism may engage an axial protrusion on an end of a rotary-type magazine or may engage a recess in a side of a box-type magazine. The latch mechanism may be spring biased so that when depressed by a finger the magazine drops out a bottom of the carrier. The connector may be, for example, a clip that attaches to a belt or other article that is worn by a user or a clamp that attaches to an accessory rail or other part of a firearm that is carried by a user.

11 Claims, 25 Drawing Sheets

(56) References Cited

U.S. PATENT DOCUMENTS

| | | | | |
|---|---|---|---|---|
| 8,191,298 | B2 | 6/2012 | Cash et al. | |
| 8,231,038 | B2 | 7/2012 | Felts | |
| 8,322,065 | B2 | 12/2012 | Faifer | |
| 8,733,606 | B2 | 5/2014 | Felts | |
| 8,739,451 | B2 | 6/2014 | Nelson | |
| 8,776,426 | B1 | 7/2014 | Symonds | |
| 9,175,923 | B2 * | 11/2015 | Ruby | F41C 27/00 |
| 2007/0278269 | A1 | 12/2007 | Rogers et al. | |
| 2011/0107645 | A1 | 5/2011 | Faifer | |

* cited by examiner

QUICK RELEASE CARRIER FOR AMMUNITION MAGAZINES

RELATED CASES

This application claims the benefit of U.S. Provisional Patent Application Ser. No. 62/176,508 filed on Feb. 19, 2015.

BACKGROUND a. Field of the Invention

The present invention relates generally to accessories for firearms, and, more particularly, a quick release carrier for spare ammunition magazines used primarily in rifles.

b. Related Art

Detachable ammunition magazines are a feature of many modern firearms, including both civilian and military/police rifles. It is common practice for shooters of magazine-fed firearms to carry with them one or more additional, pre-loaded magazines, in order to more quickly continue using the firearm after emptying a magazine and to avoid the difficulties and lost time inherent in reloading magazines in the field.

As a first example, rotary-type ammunition magazines have been employed in certain types of firearms, primarily in certain models of sporting rifles. The most prominent in current production is the Ruger 10/22™ rifle, which is one of the most popular and best selling firearms in history.

Characteristically, a rotary-type ammunition magazine includes a spring-loaded spindle-type rotor having a series of channels or flutes about its perimeter that cooperate with the cartridges. The cartridges are normally loaded into the magazine by hand and then fed back into the receiver during operation of the firearm. In the case of the Ruger 10/22™ rifle the rotor operates within a shell having a throat at the top via which the cartridges enter and exit the magazine. The rotor is supported for rotation on an axle shaft that extends longitudinally through the shell, the shaft being formed by a screw having a head protruding at one end of the magazine and threaded end protruding from a cap nut at the other. The magazines are inserted upwardly into a magazine well in the bottom of the rifle, and have a projecting tooth on one end and a cupped recess on the other, that cooperate with the rifle mechanism to releasably retain the magazine in the well. An example Ruger 10/22™ OEM-type rotary magazine is shown in FIG. 10 and will be described in greater detail below.

Since the Ruger 10/22™ rifle uses a semi-automatic mechanism and is rifle chambered for inexpensive 22 Long Rifle ammunition, the magazines are often emptied in a rapid manner. Various types of high capacity magazines have therefore been provided, such as "banana clip" and "drum magazines" for example, but as a group these are bulky, cumbersome and prone to damage, and also tend to exhibit feed problems and otherwise fail to operate as satisfactorily as the basic OEM-type rotary magazine. Also, since the Ruger 10/22™ rifle has been immensely popular since the 1960's many shooters already own a supply of the original-type magazines. Despite their functional superiority, however, the original-type magazines hold only 10 rounds and so many shooters carry multiple units on their person. This is often done in an ad hoc fashion, for example by simply shoving magazines in a coat or trousers pocket, which then requires rummaging in the pocket and fumbling with each magazine to retrieve and orientate it for installation in the rifle. Various types of pouches are also available to carry ammunition and magazines, both belt and shoulder suspended, but these are typically covered by a flap or other closure and are scarcely more convenient to use than simply carrying the magazines in a pocket.

Another, more widely employed example of detachable magazine is the box magazine, in which the cartridges are stacked in a more-or-less columnar fashion. Typically, a spring at the bottom of the magazine is compressed as the cartridges are loaded from the top, with the spring then forcing the cartridges back up to the feed opening as the cartridges are stripped out of the magazine by operation of the firearm. While many different designs exist perhaps the most common in current use are magazines for AR-Series rifles, typically in caliber .223 Remington/5.56 NATO. Originally designed for military use, the AR-Series rifles have come to be made by numerous manufacturers based on a standardized set of specifications, hence the magazines and many other parts are generally interchangeable.

AR-type rifle magazines have a typical box-like configuration, generally rectangular in horizontal cross-section. The magazines are retained in the well of the rifle by a spring-loaded pivoting catch having an inner end that engages a cooperating notch in the side of the magazine, such that the magazine can be released by pressing the end of the catch lever. Similar to the Ruger 10/22™ rifle noted above, the AR-Series rifles have semi-automatic actions and also use comparatively inexpensive ammunition, so that it is a common occurrence for the magazines to be emptied and replaced on a rapid basis. As compared with the Ruger 10/22™, however, the AR-Series magazines are larger, bulkier and heavier, and consequently present even more of challenge when carrying spare magazines in a field environment.

Accordingly, there exists a need for an apparatus for carrying spare ammunition magazines for rifles in a convenient and organized manner. Furthermore, there exists a need for such an apparatus that allows spare magazines to be retrieved for use in a rapid and convenient fashion. Still further, there exists a need for such an apparatus that is durable and convenient to carry and use in a field environment.

SUMMARY OF THE INVENTION

The present invention addresses the problems cited above, and provides a carrier assembly for spare ammunition magazines from which the magazines are releasable in a rapid and efficient manner.

Broadly, the carrier assembly comprises (a) a carrier body having a shell with a bottom opening and an interior dimensioned to receive a magazine, (b) a latch mechanism that releasably engages a feature of the magazine so as to retain the magazine in the shell, and (c) a connector member that attaches the carrier body to an article worn or carried by a user.

In a first aspect, the magazine that is received by the shell of the carrier body may be a rotary-type magazine. The latch mechanism may comprise a latch lever member mounted to the housing that operates an engagement portion that engages an axial protrusion on the end of the rotary-type magazine. The axial protrusion may be an end of a screw that forms an axle for an internal rotor of the magazine, and the engagement portion may comprise a recess that receives the axial protrusion therein. The rotary-type magazine may be a magazine designed for use in a Ruger 10/22™ rifle.

The latch mechanism may further comprise a spring that yieldingly biases the engagement portion of the latch mechanism into engagement with the axial protrusion on the magazine. The latch member may comprise a pivotable lever that is manually operable to overcome the spring so as to move the engagement portion out of engagement with the axial protrusion of the magazine and thereby release the magazine from the shell of the carrier. The lever may comprise an end portion that is selectively depressible by pressure exerted by a thumb or finger. The spring may comprise a plunger having an end that bears against the lever and a compression spring that yieldingly biases the plunger against the lever. The engagement portion may comprise a recess formed on a lower end portion of the lever or may comprise a recess formed on a coupler member that is in operative engagement with the lower end of the lever.

The shell of the carrier body may comprise a cover portion, first and second side walls, and first and second end walls. The engagement portion of the latch may be located at the first end wall of the shell to engage the axial protrusion of the magazine. The carrier body may comprise at least one mounting portion that releasably mounts the connector member thereto. The at least one mounting portion may comprise first, second and third mounting portions located at the second end wall and first and second side walls of the shell of the carrier body. The mounting portion of the connector member may comprise an extension of the connector member having a flattened cross-section and a locking feature on a lower end thereof, and the mounting portion of the body of the carrier may comprise a slot that slidingly receives the mounting extension of the carrier and a locking feature that engages the locking feature on the extension to hold the connector member against being withdrawn from the body. The locking feature on the extension of the connector member may comprise a locking tooth and the locking feature on the carrier body may comprise a cooperating notch at a lower end of the slot.

The connector member of the carrier assembly may comprise a connector member that engages an article of clothing worn by a user. The connector member may comprise a clip that releasably engages a belt worn by a user. The connector member may also comprise a connector member that mounts to an article carried by the user. The connector member may comprise a clamp assembly that detachably mounts to an accessory rail on a rifle or other firearm carried by the user.

In another aspect, the magazine that is received by the shell of the carrier body may be a box-type magazine. The releasable latch may comprise a latch mechanism that engages a locking feature on the box magazine. The box magazine may be a magazine designed for use in AR-Series rifles, and the locking feature on the magazine may comprise a recess formed in a side of the magazine. The shell of the carrier body may comprise a slot that cooperates with a rearward rib on the magazine to properly orientate the magazine within the carrier.

The latch mechanism may comprise an actuator rod that is operatively connected to a latch piece so as to withdraw the latch piece from the catch recess in the side of a magazine in response to actuation of the rod by a user. The actuator rod may be a spring-biased rod that is selectively depressible by a user. The actuator rod may comprise a sloped face that engages a cooperating surface on the latch piece so as to draw the latch piece away from the recess in the magazine as the actuating rod is depressed. The latch piece may comprise a latch block having a passage through which the actuator passes, the passage in the latch block having the surface that cooperates with the sloped face on the actuator rod.

The shell of the carrier body for the box-type magazine may further comprise an attachment member that releasably mounts a connector member thereto. The shell of the carrier body may comprise a generally box-shaped shell having a substantially rectangular horizontal cross-section. The attachment member may comprise a generally U-shaped bracket having first and second end flanges that are mounted to first and second end walls of the box-shaped shell of the carrier body. The attachment member may comprise a slot that slidingly receives an extension portion of the connector member. The connector member may be, for example, in a belt clip or a clamp for mounting to an accessory rail.

These and other features and advantages of the present invention will be more fully appreciated from a reading of the following detailed description with reference to the accompanying drawings.

DETAILED DESCRIPTION

Figure 1:
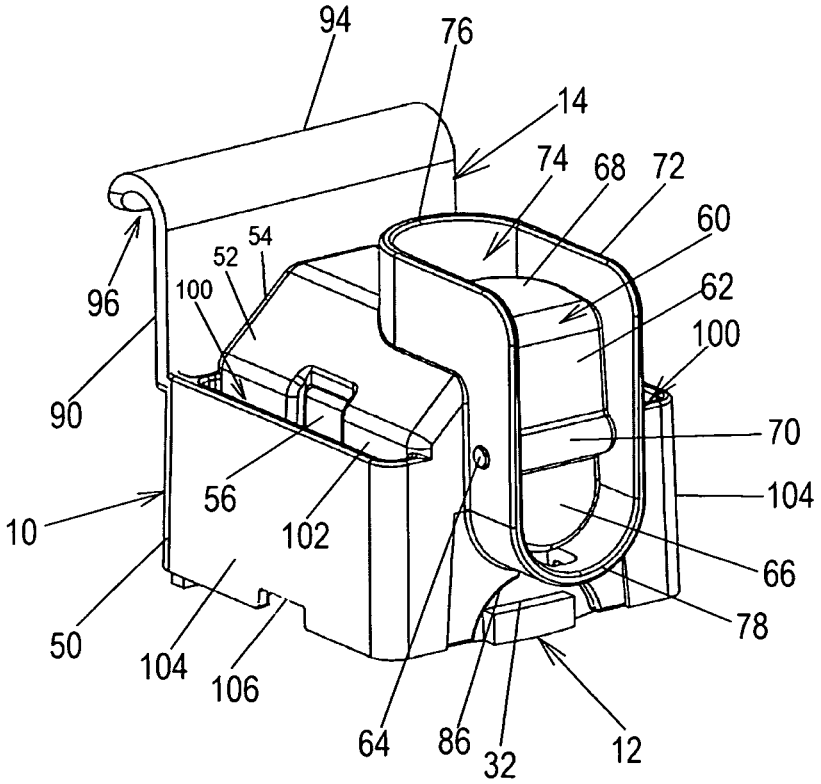
FIG. 1 is a perspective view of a magazine carrier in accordance with the present invention, with an example rotary magazine releasably secured in the carrier, the carrier being fitted with a belt clip connector member mounted in a first position such that the carrier will extend in a direction generally perpendicular to the belt.

FIG. 1 shows a magazine carrier 10 in accordance with a first embodiment of the present invention, releasably holding an exemplary OEM-type rotary magazine for a Ruger 10/22™ rifle. The carrier is in turn fitted with a connector member in the form of a belt clip 14 so as to be supportable from a belt or similar article of clothing worn by a user and therefore conveniently carried in a field environment.

Figure 16:
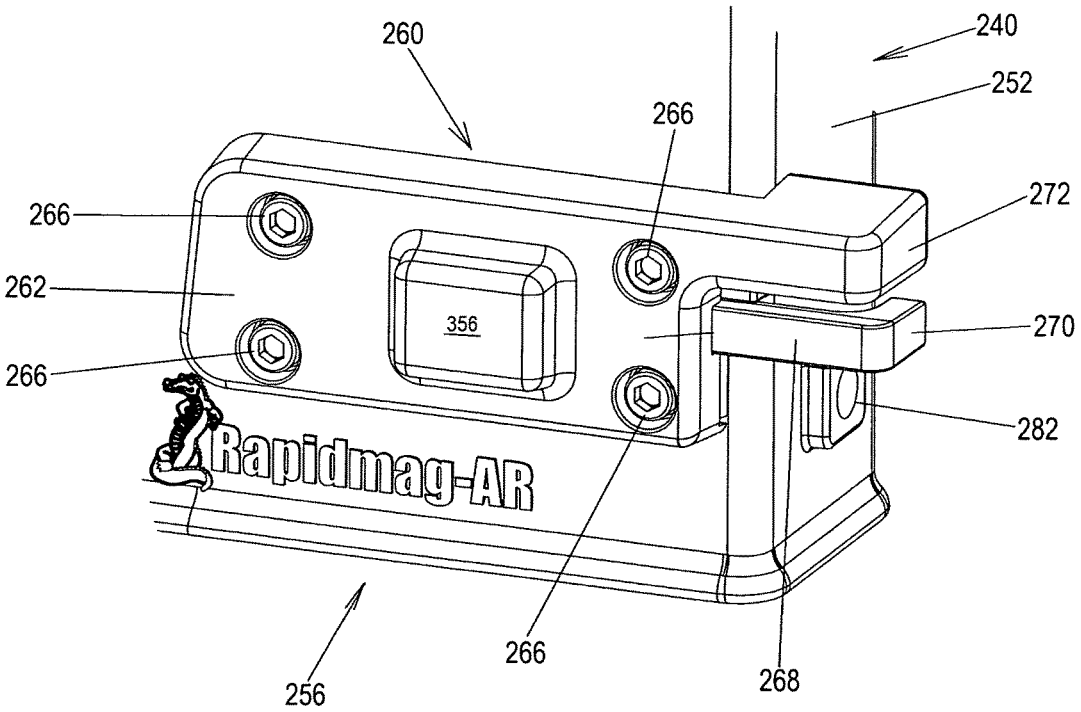
FIG. 16 is a partial, enlarged perspective view of the magazine carrier of FIG. 12, showing the external components of the magazine release mechanism in greater detail.
Figure 17:
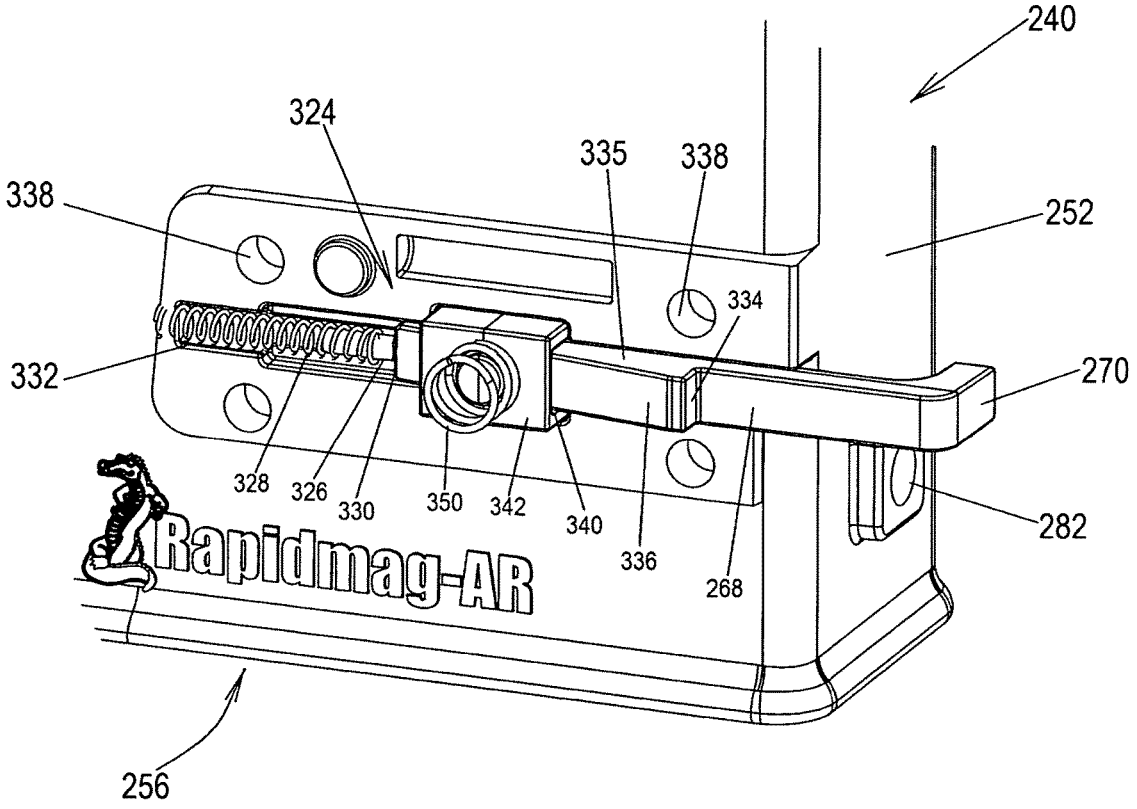
FIG. 17 is a partial, enlarged perspective view, similar to FIG. 16, showing the internal components of the release mechanism of the magazine carrier of FIG. 12.
Figure 18:
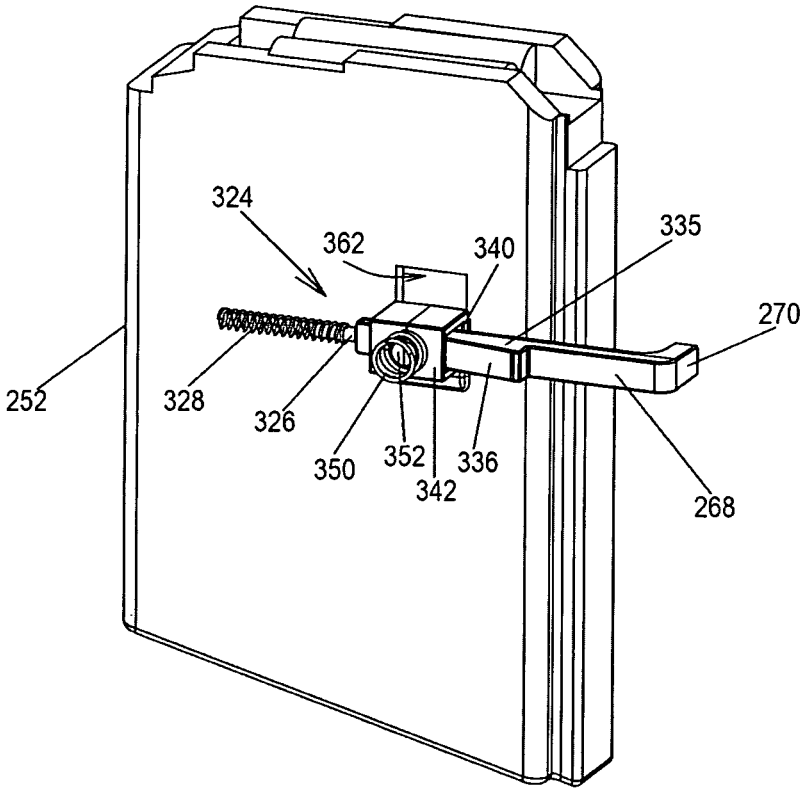
FIG. 18 is a partial, enlarged view of the actuator rod and other internal components of the release mechanism of FIGS. 16-17, showing the relationship thereof with a cooperating opening into the interior of the carrier housing through which the catch recess in the magazine is accessed.
Figure 19:
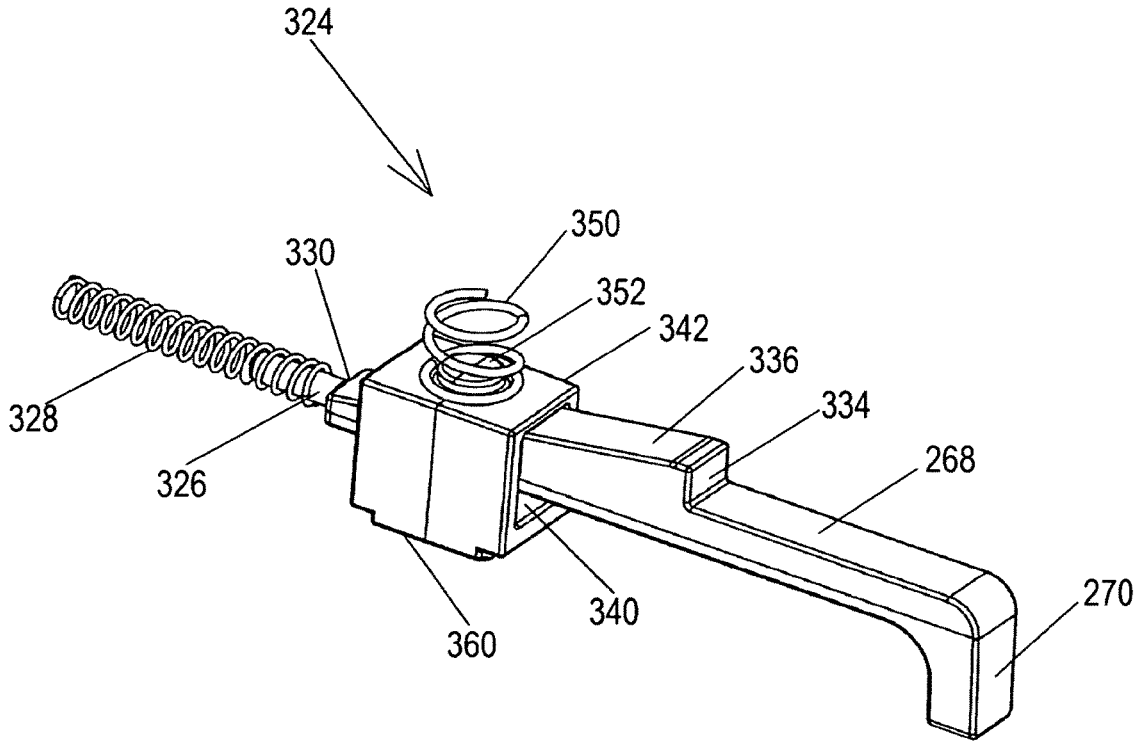
FIG. 19 is a perspective view of the magazine release assembly of FIGS. 17-18.
Figure 20:
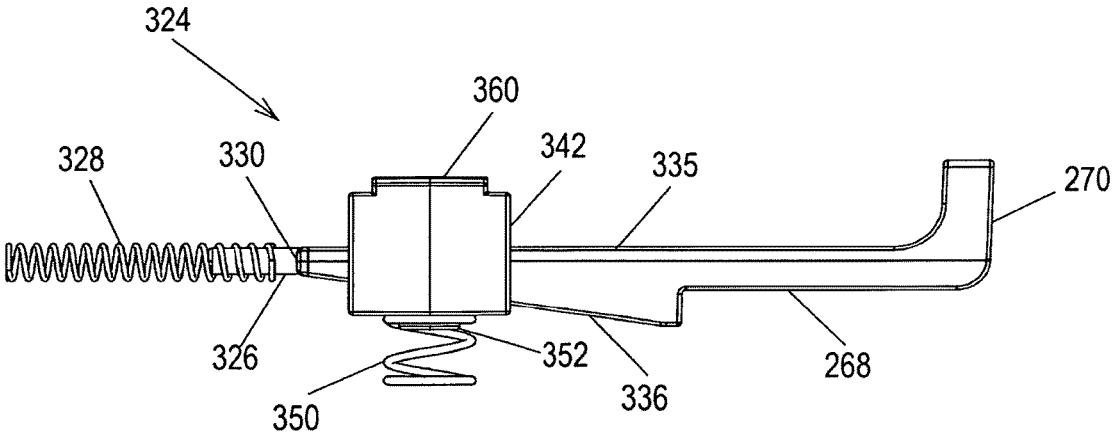
FIG. 20 is a top plan view of the magazine release components of FIG. 19, showing the relationship thereof in greater detail.

The OEM-type Ruger 10/22™ magazine 12 that is shown is well known in the prior art and therefore does not itself form a part of the present invention. As can be seen in FIGS. 16-18, the magazine is generally block-shaped externally, having a somewhat rectangular housing 16. The housing includes generally vertically extending side walls 20, 22 and end walls 24 and 26, the last including a cover plate that is removable to access the interior components of the magazine. A tab or tooth 30 projects from the end of the housing at the lower edge of wall 28, while a recess 32 bordered by a lower lip 34 is formed in the opposite end at the lower edge of wall 24. The upper end 36 of the magazine housing is somewhat raised, with the ammunition throat piece 38 projecting upwardly therefrom. The lower wall 40, in turn, is generally horizontal with an upward recess 42.

As noted above, the housing 16 encloses a spring-loaded rotor that cooperates with the cartridges as they are fed into and out of the magazine. In the Ruger 10/22™ magazine shown in FIGS. 10-12, the rotor is supported on an axle formed by a screw 44 having a shaft 46 that extends longitudinally through the housing. As can be seen in FIGS. 16-18, the head 48 of the screw protrudes somewhat from the first end wall 24 of the housing, and the end of the shaft 46 protrudes from a crown nut set in the opposite end wall 26. As will be described in greater detail below, the protruding ends of the screw provide grip points that are detachably engaged by the magazine carrier of the present invention. The embodiment of the magazine carrier that is shown in FIGS. 1-9 and described herein is particularly adapted to use with magazines designed for use with Ruger 10/22™ rifles, it will be understood that other embodiments may be configured for use with magazines of other designs and makes having features engagable by the carrier substantially as described below.

Referring again to FIG. 1, the magazine carrier 10 includes a body 50, suitably molded unitarily of a durable plastic material. Body 50 includes a shell 52 that is substantially rectangular in plan view and includes generally vertical side and end walls that correspond generally to the side and end walls of the magazine, but are spaced outwardly to provide clearance that permits the magazine to move vertically within the shell. The bottom of the shell is open to receive the magazines, while the upper end is closed by a cover portion 54 that accommodates the upwardly projecting upper end of the magazine so as to protect the latter and exclude dirt/dust and water from entering the mechanism. Openings 56 are formed in the sides of the cover portion, the primary function of which is to allow mounting of different carrier attachments as will be described below, but which also allow a screwdriver of other implement to be inserted to help dislodge the magazine should this become jammed in the carrier, as by debris or ice, for example.

As can be seen with further reference to FIG. 1, the carrier assembly further includes a latch mechanism 60 mounted at one end of the shell 52. The latch mechanism includes an inverted L-shaped lever 62 that is pivotally connected to the housing of the carrier by a horizontal-axis pivot pin 64. A depending leg 66 of the lever extends generally vertically at the end of shell 52, while the upper leg 68 of the lever extends inwardly and generally horizontally proximate the top of the shell, a gap being formed beneath the horizontal portion of the lever to permit movement of the latter when depressed. As can be seen in FIG. 1, the pivot pin 64 is mounted approximately midway down the vertical leg 66 of the lever, passing through a cooperating sleeve 70, so that when the horizontal upper leg of the lever is depressed the lower portion of the vertical leg below sleeve 70 will pivot outwardly away from the end of shell 52.

An upstanding wall 72 surrounds lever 68 so as to form a channel 74 within which the lever is set, having generally parallel side wall portions that are spaced apart by a distance sufficient for a user's thumb/finger to be received in channel 74, the rounded upper and lower end portions 76, 78 of the wall acting to cooperate with the ends of the fingers/thumbs so as to arrest and position the latter proximate the end portions of the lever. Wall 72 and channel 74 thus aid the user in quickly and conveniently positioning a thumb or finger for operation of the latch mechanism, and also protect the latch mechanism from accidental operation or damage while being carried.

Figure 3:
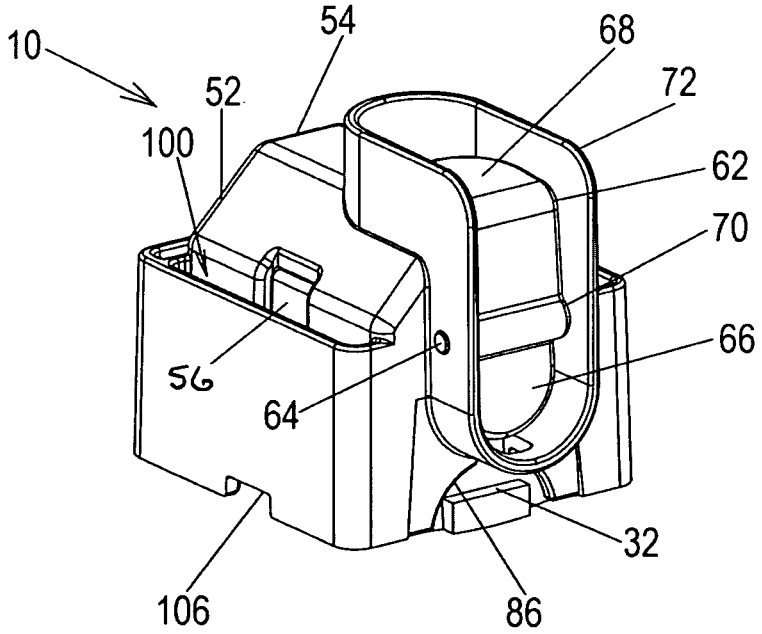
FIG. 3 is a perspective, ghosted view of the magazine carrier of FIGS. 1-2, showing the manner in which the magazine is releasably retained in the carrier by spring-loaded latch mechanism, that is actuated by finger pressure to release the magazine from the carrier.
Figure 4:
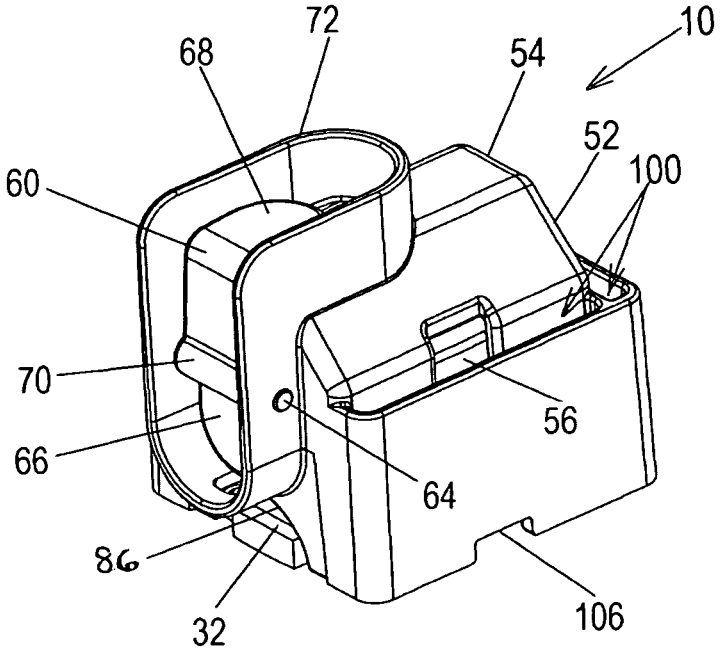
FIG. 4 is a second perspective, ghosted view of the carrier and magazine of FIG. 3, showing the latch mechanism in greater detail.

As can better be seen in FIGS. 3-4, the upper cover portion 54 of the carrier shell 52 includes a plunger not shown that is biased outwardly by a compression spring 82 in a cooperating bore, the outer end of the plunger bearing against the inside of the depending leg 66 of lever 60 at a position above the pivot pin 64. The pressure exerted by spring 82 consequently acts to force the upper portion of the lever outwardly away from shell 52, pivoting the lever around pin 64 so that the lower end portion 66 of the lever is biased in the opposite direction, i.e., inwardly towards the end of shell 52. A cup-shaped recess 86 is formed on the inside face of the lower leg 66 of the lever (i.e., the face directed towards the shell of the carrier), that is sized and configured to receive the protruding head 44 of the axle screw of magazine 12. When a magazine is inserted into the shell 52 of the carrier through the bottom opening described above, the screw head 44 protrudes at an opening in the wall of the shell so as to be captured by the shaped recess 86 on the lever. The protruding shaft end 46 of the screw is in turn received in a recess in the opposite end wall of the shell. Pressing the upper portion of lever 60 to overcome the spring-loaded plunger in turn causes the lower end portion of the lever to pivot in the opposite direction, i.e., away from the end of shell 52, so that the recess 86 moves out of engagement with the screw head 44 to allow the magazine to drop out of the bottom of the carrier.

The opening at the bottom of the carrier shell 52 is dimensioned to receive a magazine 12 when the latter is held in a vertical orientation with the screw head 44 disposed towards the end of the carrier having the latch mechanism. The cover portion 54 of the shell in turn acts as a stop, reacting with the upper side 36 of the magazine to arrest insertion of the latter in a position with the screw head 34 approximately level with or above the engagement recess 86. The inside face of the lever below the engagement recess includes a ramp that allows the screw head to ride up the surface and enter the recess without the user having to depress the lever. When pressed home into the shell of the carrier and locked in place by the latch mechanism, the bottom of the magazine lies flush or slightly recessed within the carrier.

Accordingly, to install a magazine in carrier 10, the user simply holds the magazine upright and aligns it with the opening in the carrier, and then presses the magazine upwardly into the interior of shell 52. The ramp on the inside of the latch lever rides over the protruding screw head 44, with the spring-loaded plunger yielding as this is done, until the screw head comes level with the latching recess and the lower end of the lever pivots back inwardly to engage the screw head and lock the magazine in place. The magazine is thus held securely in place to be carried or transported about until needed.

Then, to release the magazine, the user simply presses the upper part of the lever downwardly/inwardly so as to compress the spring-loaded plunger and retract the latching recess from the screw head of the magazine, freeing the magazine to drop out the opening in the lower side of shell 52. To aid in removing the magazine the user may insert a thumb or finger through a notch 86 formed in the lower edge of the shell and into the catch recess 32 in the end of the magazine, pivoting the convex upper surface of the thumb-nail/fingernail against the semi-circular edge of the notch and pushing downwardly against the ledge 34 at the bottom of the recess with the end of the nail if desired. Thus retrieved, the magazine is held in a natural and convenient manner, with the thumb in the recess at one end and the forefinger wrapped around the other, and is in the proper orientation to be inserted into the rifle, which can be done by simply rotating the wrist slightly to align the magazine with the well and then pressing upwardly with the middle/other fingers of the hand. The carrier of the present invention therefore allows magazines to be changed in a rapid and fluid manner, with minimal hand movements and no fum-bling involved in retrieving and aligning the magazine.

As noted above, the body of the magazine carrier may be fitted with connector members that permit the carrier to be supported from the user's person or from the rifle or other article so as to be conveniently carried in the field. In the assemblies shown in FIGS. 1-2, the connector member is a belt clip 14. The clip 14 is suitably formed unitarily of a rigid or semi-rigid plastic material, and includes an upwardly extending panel-shaped front leg 90 that fits against the outside of the belt and a resiliently flexible rearward leg 92 that slides behind the belt, the front and rearward legs 90, 92 being joined at an upper edge 94 so as to define a channel 96 that receives the belt when the clip is slipped thereover.

The lower end of the belt clip connector member in turn includes a necked down extension portion that depends from the front panel 90 and includes a retainer tooth 98 on its lower end. In order to join the connector member to the carrier body, the extension portion on the lower end of panel 90 is inserted into a selected one of a series of three slots 100 formed on the sides and end of the carrier body. Slots 100 are each defined by a side 102 of the carrier shell 52 and a parallel wall portion 104 that is spaced outwardly therefrom to form a gap sized to receive the lower end of the connector member. As the lower end of the connector member is inserted into the slot 100, the extension portion and the outwardly facing tooth 98 on the lower end thereof enter at opening 56, with an outwardly facing ramp on the tooth reacting against the upper edge of wall 104 to resiliently bend the extension portion inwardly. Upon reaching the bottom of the slot the connector tooth snaps back out into a notch 106 at the bottom so that the upper surface of the tooth reacts against the cooperating surface of the notch to retain the connector against being withdrawn. Then, when desired, the connector member may be removed by manually depressing the tooth out of engagement with the notch and withdrawing the member from slot 100.

Figure 2:
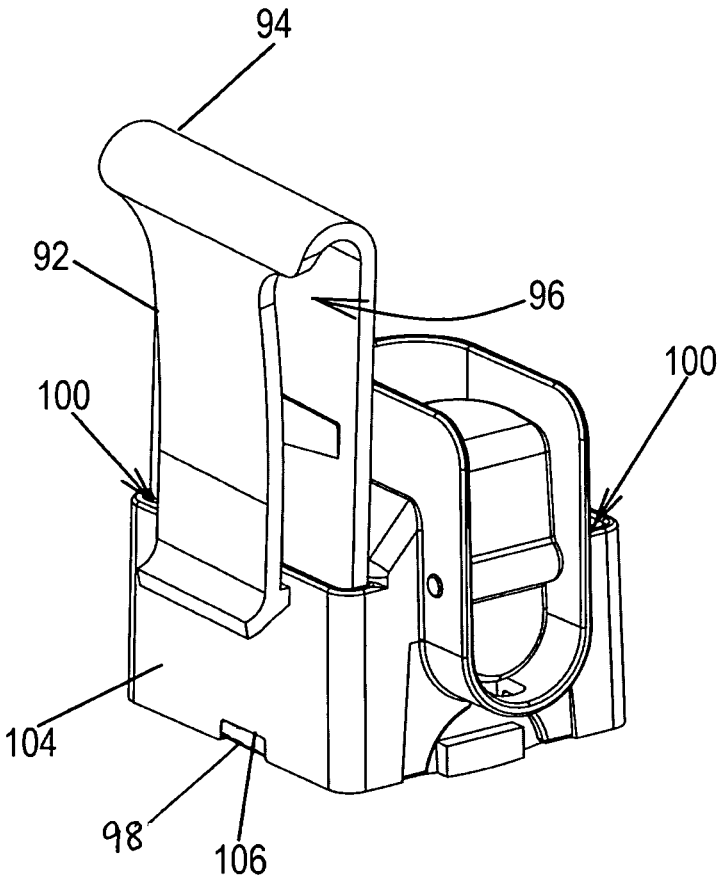
FIG. 2 is a second perspective view of the magazine carrier of FIG. 1, showing the carrier with the belt clip connector member installed in a second position such that the carrier will extend generally parallel to the belt when worn.

The inclusion of three mounting slots 100 allows the connector member to be mounted to the body of the carrier in three different positions at 90° intervals. For example, FIG. 1 shows the belt clip connector member 14 mounted in the rear slot of the carrier body opposite the latch mechanism 60, so that the latch mechanism faces outwardly from the belt when worn. FIG. 2 in turn shows the connector member mounted in one of the side slots such that the latch mechanism will face towards the rear if worn on the right hip. This allows the user to select the orientation of the clip in accordance with personal preference, and also serves to accommodate both right-handed and left-handed users.

Figure 5:
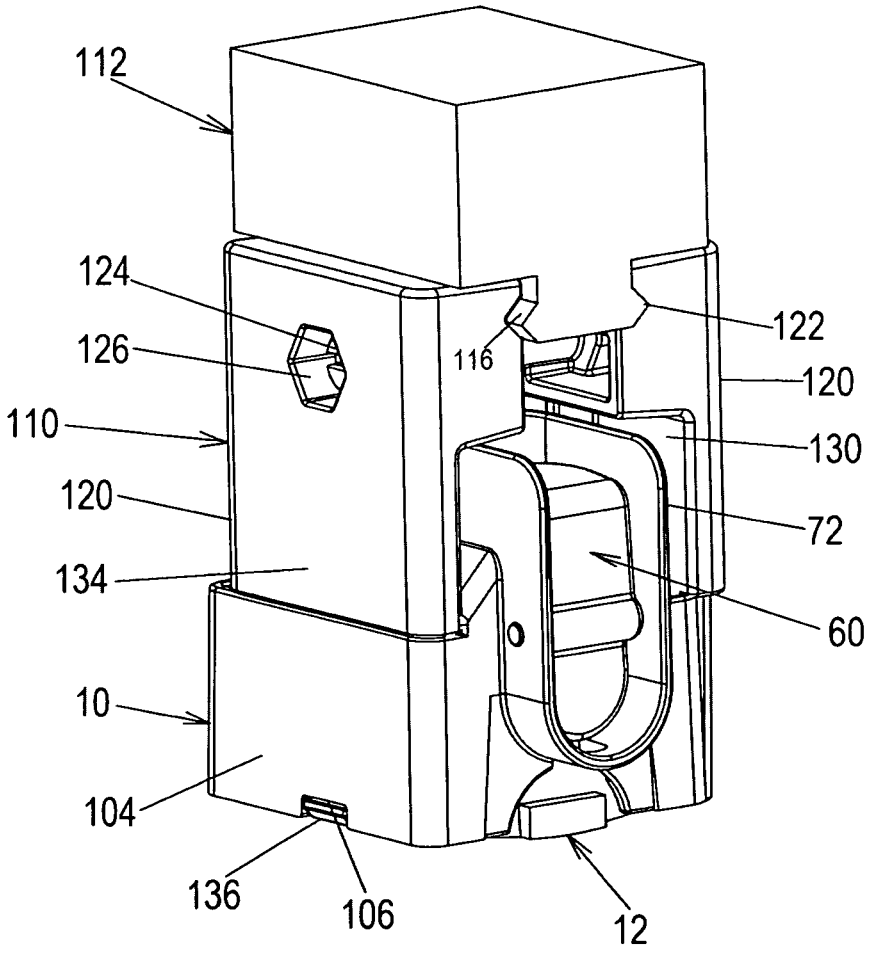
FIG. 5 is a perspective view of the magazine carrier of the FIGS. 1-4, with an accessory rail mount clamp installed in place of a belt clip of FIGS. 1-2 so that the carrier assembly can be carried on a cooperating rail of a firearm.
Figure 6:
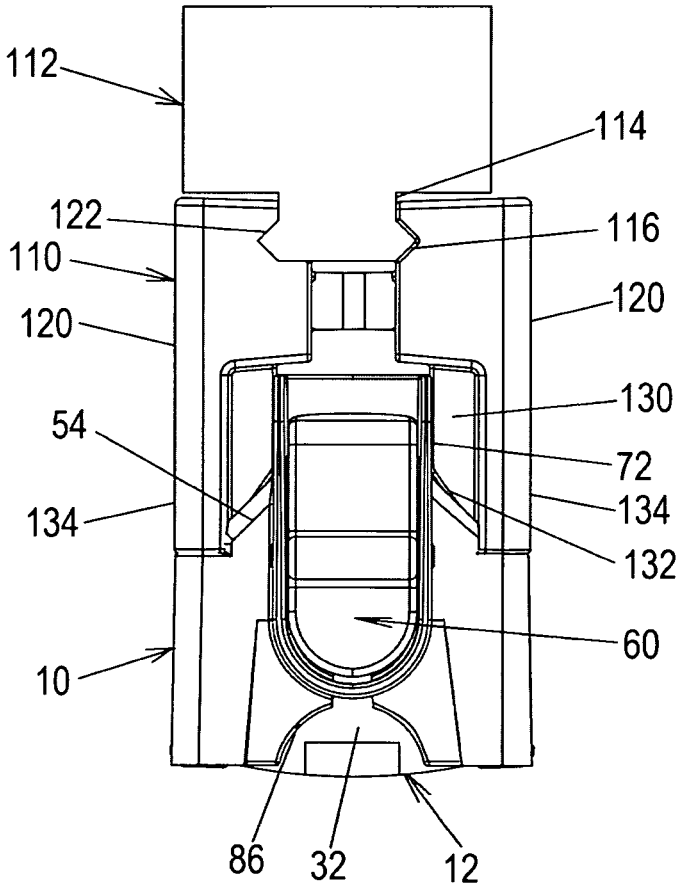
FIG. 6 is an end elevational view of the magazine carrier and accessory rail mount assembly of FIG. 5, showing the manner in which the mount engages an accessory rail of a firearm so as to support the assembly therefrom.

FIG. 5 shows a second attachment fitting 110 that mounds to an accessory rail 112 so as to allow the assembly to be carried from a rifle or other item so equipped rather than from a belt or other article of clothing on the user's person. By way of background, and as is shown in FIGS. 5-6, an accessory rail is a form of mount commonly used on rifles and other firearms, for attachment of optical scopes, flashlights/illumination devices, and other accessories. Common forms of accessory rails include the Picatinny rail, Weaver rail and NATO Accessory rail. Conventionally, an accessory rail has a somewhat T-shaped cross-section, with a base that is attachable to the firearm and an elongate rail portion 114 having outwardly facing ridges 116 on both sides. Depending on configuration, the accessory rail may be mounted under, over or to the side of the barrel or stock of the firearm; moreover, multiple accessory rails may be fitted to a single firearm.

The connector member 110 for mounting to an accessory rail includes first and second identical clamp members 120 having inwardly facing jaw grooves 122 at their upper ends that are contoured to receive the corresponding side ridges 116 of the rail. The clamp members are joined together by a transversely extending bolt 124 having a head and nut that are received in cooperating hex-shaped recesses 126 and that passes through coaxially aligned sleeve portions 128 in the upper ends of the two clamp members. Recesses 130 are formed in the front and rear sides of the clamp members below the bolt to provide clearance for the latch mechanism 60 and surrounding wall 172, and the lower sides 132 of the recessed portions are in turn sloped to accommodate the upwardly extending cover portion 54 of the carrier shell.

The lower end 134 of each clamp half is generally similar in configuration to the corresponding portion of the belt clip connector member described above, having a flattened wall and a depending extension portion with an outwardly projecting tooth 136 on its lower end. To install the clamp halves the extension portions of the two clamp halves are inserted into the slots 100 on opposite sides of the carrier body, and pressed downwardly until the tooth portions spring out to engage the notches 106 in the manner previously described. The upper ends of the jaw pieces are slipped over the accessory rail 112 and the bolt 124 then tightened to grip the edges 116 of the rail firmly within the jaw portions 122 of the connector member. Thus installed, the carrier assembly and enclosed magazine can be carried conveniently and can be accessed by the user in a manner similar to that described above.

Figure 7:
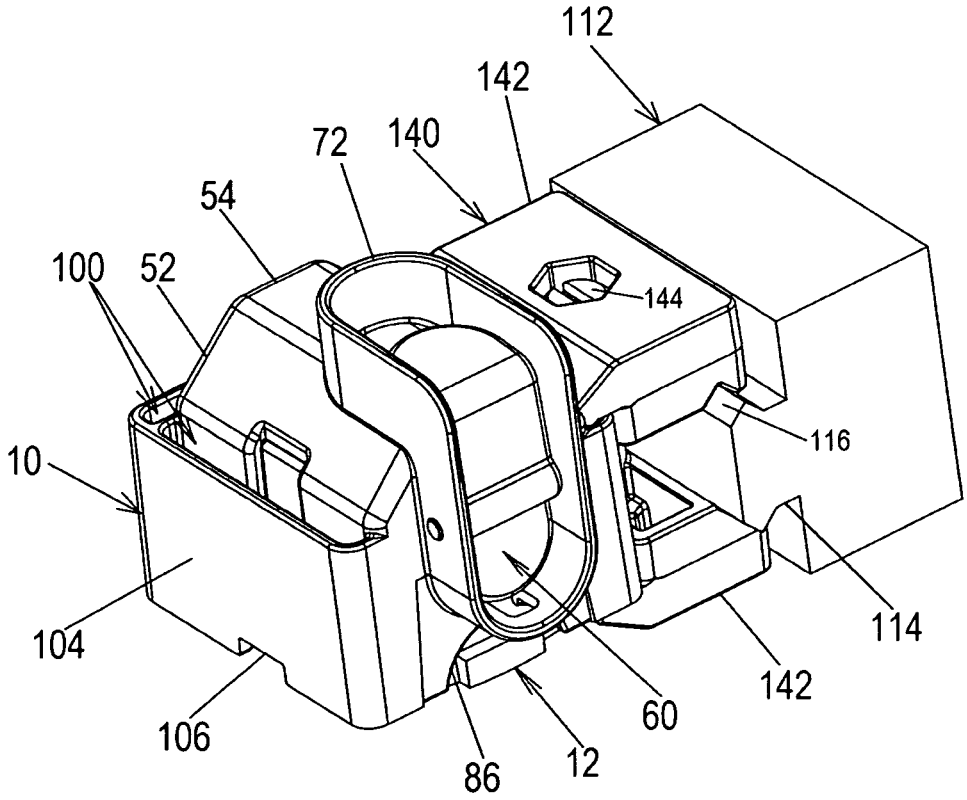
FIG. 7 is a second perspective view of the magazine carrier and accessory rail mount of FIGS. 5-6, with the rail mount attached to the carrier in a second position so as to support the assembly in a second orientation relative to a cooperating rail of a firearm.
Figure 8:
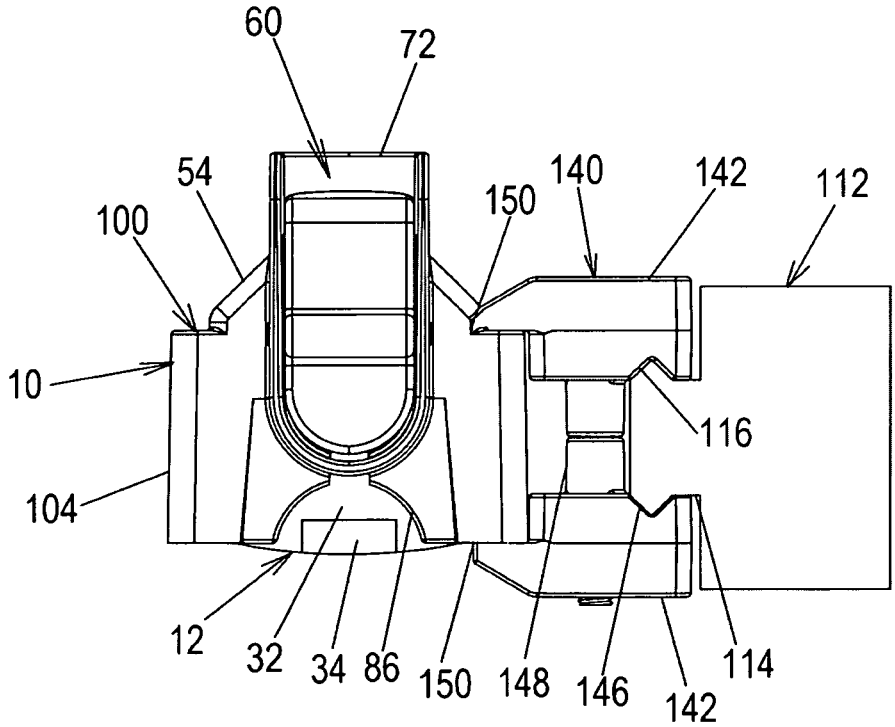
FIG. 8 is an end elevational view of the magazine carrier and accessory rail mount of FIG. 7, showing in greater detail the manner in which the mount engages the carrier and the rail so as to support the former in the second orientation.

FIGS. 7-8 show another connector member for mounting the carrier assembly to an accessory rail, but with the orientation of the carrier and magazine rotated 90° relative to that shown in FIGS. 5-6. As can be seen, connector member 140 similarly includes first and second clamp halves 142 joined in a direction transverse to the rail by an adjustable bolt 144 passing through coaxially aligned sleever portions 148, and having V-shaped jaw grooves 146 that cooperatingly engage the rail ribs 116 of the rail. Rather than downwardly projecting extension portions, however, the ends of the two clamp halves opposite the rail include convergently extending flange portions 150 that are received in the upper and lower openings of the mounting slots 100. Thus, to install the assembly, with the bolt slack the two flanges 150 are inserted into the upper and lower ends of one of the slots and the jaw grooves fitted over the ribs 146 of the accessory rail, and the bolt then tightened to clamp the carrier assembly in position on the rail. As noted above, the accessory rail may be mounted in any of a number of positions on a firearm or other piece of equipment, therefore the carrier 10 may be held vertically or horizontally in various places as desired.

Figure 9:
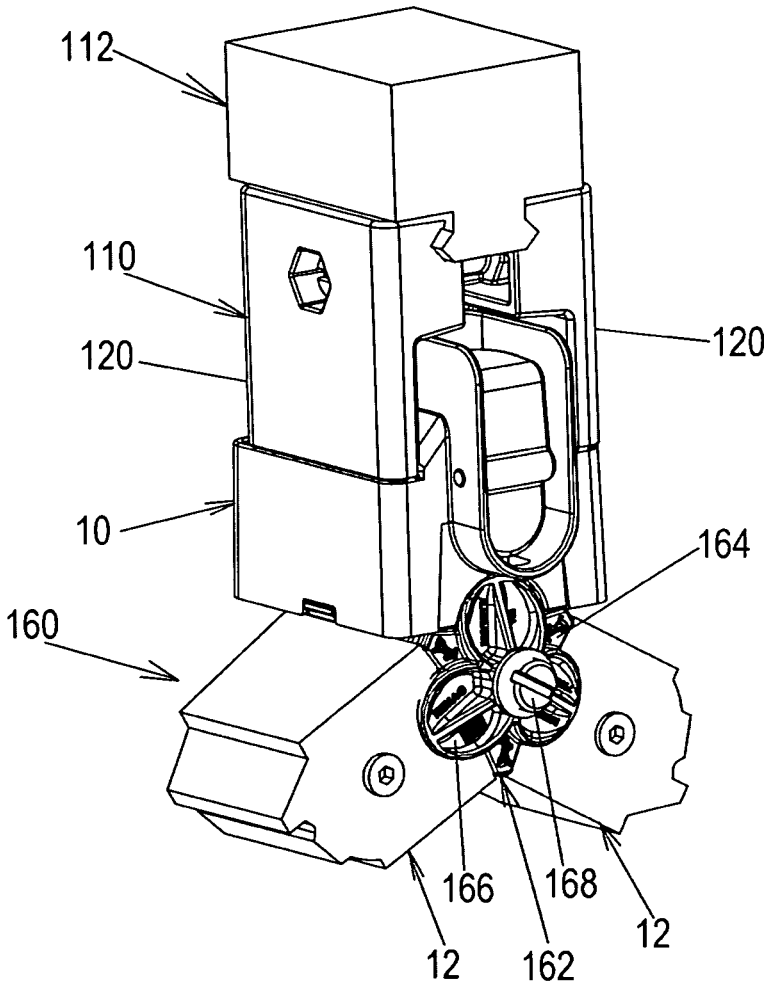
FIG. 9 is a perspective view of the magazine carrier and accessory rail mount of FIGS. 5-6, showing the carrier holding one of a trio of magazines assembled together so as to support and carry all three magazines at the same time.

FIG. 9 shows the magazine carrier 10, with the accessory rail connector member 110 of FIG. 5, employed to support a plurality of magazines 12 joined together and secured to a connector block 164 by an end cap 166 and screw 168, as disclosed in co-owned U.S. Pat. No. 7,975,420. The carrier and attachments of the present invention may therefore be used to hold multiple magazines for added convenience. Moreover, other forms of grouped and/or extended magazines designed to be used with Ruger 10/22™ rifles, some of which may not include the same rotary mechanism as the OEM-type magazine described above, may cooperate and be secured in the carrier in a similar manner.

It will be understood that other types and forms of connector members may be used in conjunction with the slotted carrier body of the carrier in addition to those described above, such as other forms of clips, clamps and straps, for example.

Figure 10:
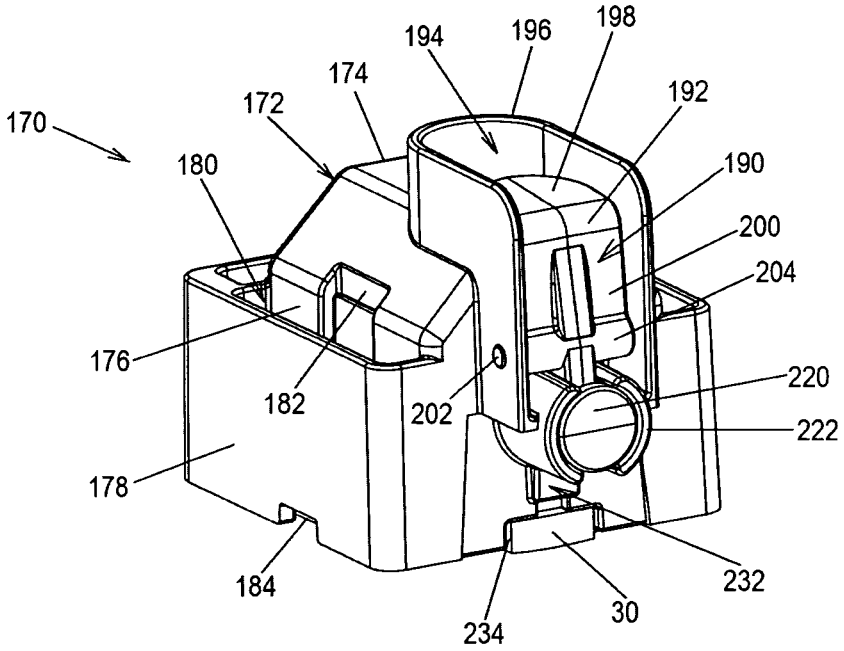
FIG. 10 is a perspective view of another magazine carrier in accordance with the present invention, with an example rotary magazine releasably secured in the carrier, the magazine carrier of FIG. 10 having a latch mechanism differently configured from the embodiment of FIGS. 1-9.
Figure 11:
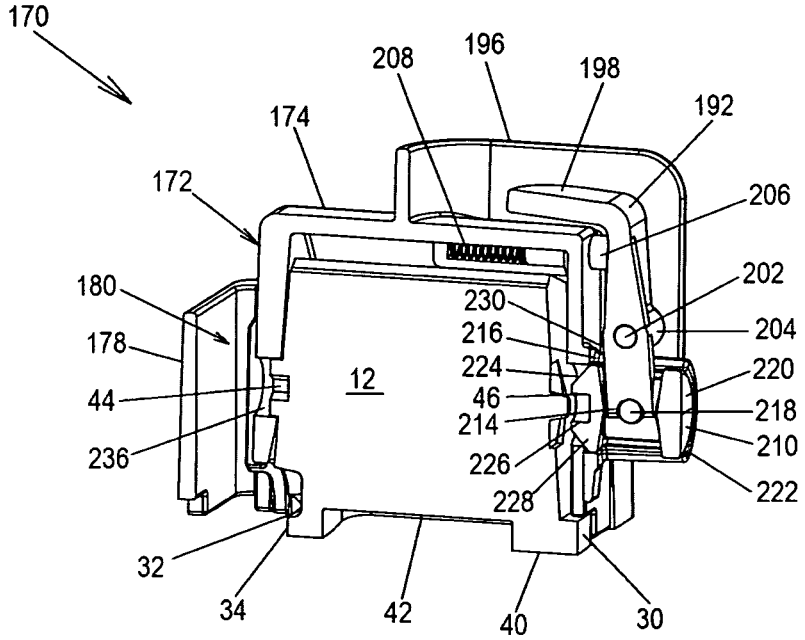
FIG. 11 is a perspective, cross-sectional, party ghosted view of the magazine carrier of FIG. 10, showing in greater detail the latching mechanism and the manner in which the magazine is releasably engaged thereby.

FIGS. 10-11 show a magazine carrier 170 in accordance with another embodiment of the invention, having a latch mechanism differently configured from that described above. The body of the carrier is generally similar, including a shell 172 with a bottom opening for magazine and an upwardly extending cover portion 174. Side walls 176 that cooperate with parallel parallel outwardly-spaced walls 178 to define slots 180 for attachment of the connector members, with upper channel openings 182 and locking notches 184 that cooperate with the extension and locking tooth portions of the connector members in the manner previously described.

As can be seen with further reference to FIG. 10, the latch mechanism 190 includes a lever 192 set within a channel 194 defined by a raised, protective wall 196. Similar to that described above, lever 192 includes a somewhat horizontally and inwardly extending upper portion 198 and a generally downwardly extending portion 200, the latter being pivotally mounted to the body of the carrier by a pivot pin 202 that passes through wall 196 and a cooperating bore in a sleeve portion 204 on the lever. Consequently, pressing the upper leg 198 of the lever inwardly/downwardly causes the lower end of the lower leg 200 to pivot outwardly in a manner similar to that described above.

Rather than acting directly on the protruding mounting feature of the magazine, however, the lower end of lever 192 operates a coupling member 210 that in turn moves into and out of engagement with the magazine. As can be seen in FIG. 11, the downwardly extending portion 200 of the lever is formed as a narrowed down extension 212 having a forked lower end 214 that fits through a slot 216 in the coupler member to form a pivoting engagement with a horizontal axis pivot pin 218 in the latter. Pivot pin 218 extends parallel to the main pivot pin 202 of the lever, so that in response to the upper end of the lever being pressed inwardly the forked lower end of the lever cooperates with pin 218 to drive the coupler member in an outward direction; then, when the upper end of the lever is released the spring-loaded plunger 206 acts to drive the coupler member back in the opposite direction, towards the interior of the carrier housing.

The coupler member includes a somewhat piston-shaped head 220 at its outer end, that is supported for reciprocating in-and-out movement by cooperating sleeve 222 formed as an extension of wall 196. The inward end of the coupler member in turn includes an inwardly extending coupler portion 224 having a socket recess 226 that engages the protruding connector portion of the magazine, which in the illustrated embodiment is the distal end 46 of the rotor shaft screw. The coupler portion also includes a sloped lower ramp surface 228 that rides over the screw end 46 of the magazine in response to the latter being pressed upwardly into the carrier shell, the lower end of the lever 192 pivoting outwardly against compression spring 208 as this is done. The upper edge of the coupler portion in turn slidingly engages the horizontal lower surface of a shoulder 30 formed on the corresponding wall of the carrier shell, to resist the end of the coupler member being forced upwardly as the magazine is inserted, with the outer edge of the shoulder also acting as a stop against the lower end portion of lever 192 to limit inward movement of the coupler member so as to correctly position the latter in preparation for insertion of the magazine.

A slot 232 formed in the wall of the shell below the coupler member accommodates upward movement of the protruding screw end 46, while the tooth 30 at the end of the magazine is accommodated by a notch 234 formed in the lower end of the wall, the notch also acting as a stop to arrest insertion of the magazine at a point where the screw end is properly positioned relative to the socket 226 of the coupler member. A recess 236 in the opposite wall of the magazine shell in turn accommodates the head 44 of the screw when pressed therein by operation of the spring-loaded latch mechanism.

As compared with the embodiment described above, that shown in FIGS. 10-11 offers the advantages of a somewhat more positive locking action and firmer engagement with the magazine. Various connector members can be attached to the body of the carrier 170 in the same manner as described above.

Figure 27:
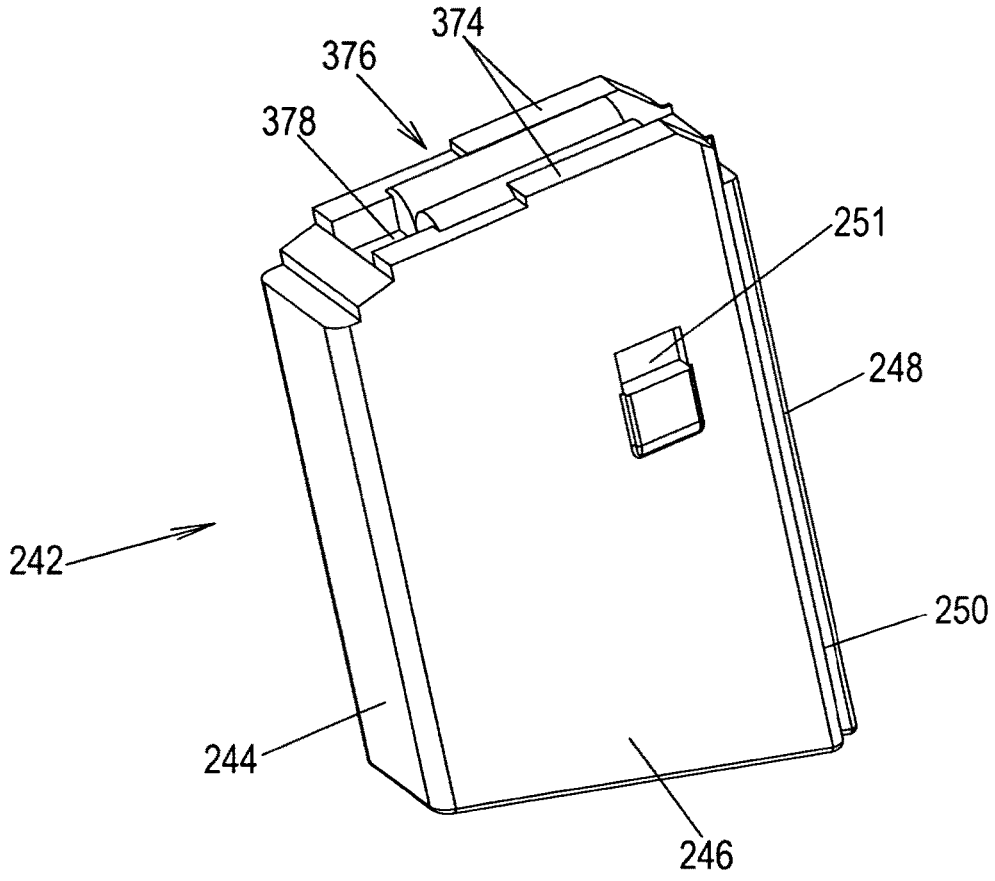
FIG. 27 is a perspective view of a standard box-type magazine for use in an AR-series rifle, such as is carried in the assembly shown in FIGS. 12-23.

FIGS. 12-15 show a carrier assembly 240 in accordance with another embodiment, that is adapted for use with box magazines rather than the rotary magazines described above, and in particular for use with box magazines designed for use with standardized AR-type rifles. As can be seen in FIG. 27, AR-type magazines 242 (as used in AR-15/M16 rifles and various derivative, for example) conventionally are roughly rectangular in horizontal cross-section, with front and side walls 244, 246 and a broad, raised rib 248 on the rear wall 250, the rib serving in part to ensure proper orientation of the magazine when inserted in the well of the rifle. A recessed locking notch 251 is formed in the left side of the magazine, that cooperates with the magazine catch of the rifle to releasably retain the magazine in the well.

Figure 12:
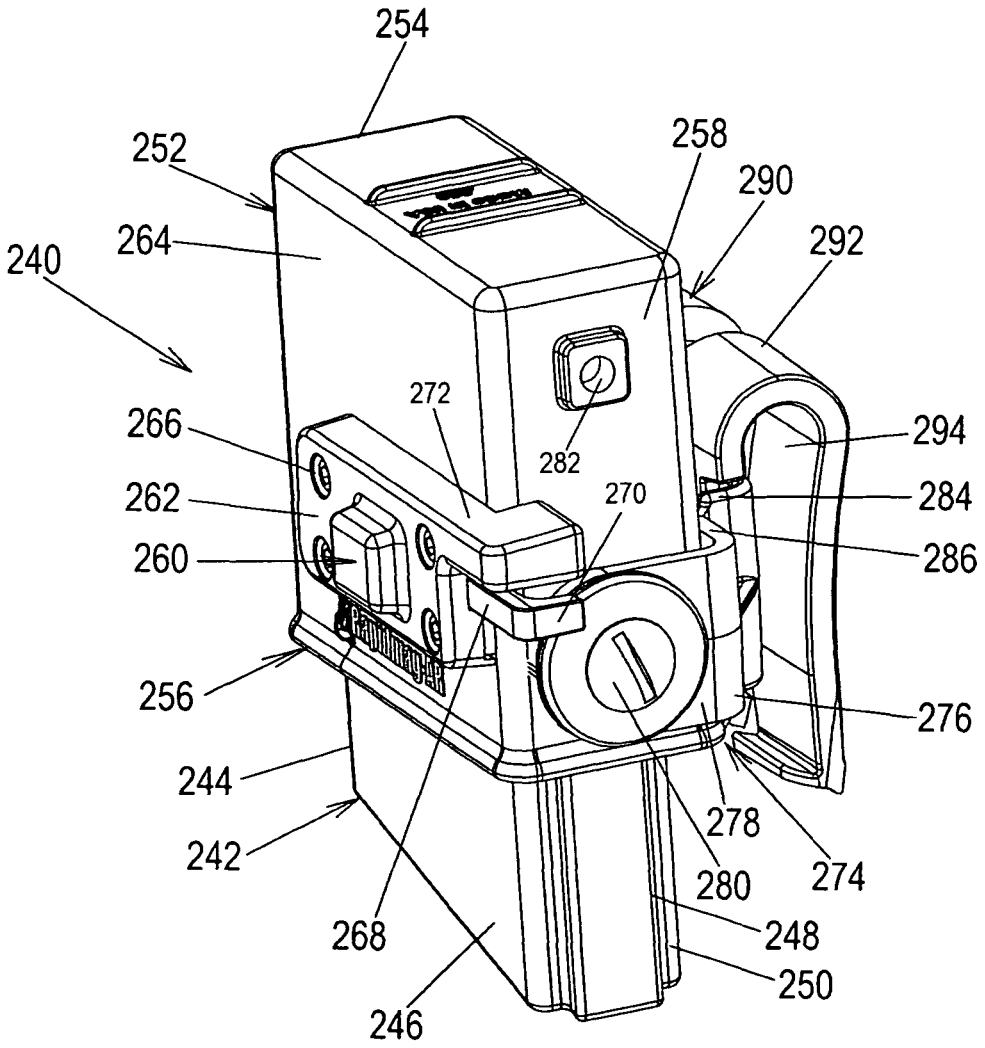
FIG. 12 is a perspective view of another magazine carrier in accordance with the present invention, with an example AR-type box magazine releasably secured in the carrier and the carrier being fitted with a belt-clip connector member.

As can be seen in FIG. 12, carrier assembly 240 includes a box-shaped shell 252 having a rectangular horizontal cross-section corresponding generally to that of the magazine, with a closed corner cover 254 at the upper end and opening 256 at the lower end for insertion of the magazine. The bottom opening and the interior of the shell are dimensioned to receive the magazine in close-fitting, sliding relationship, with a channel being formed in the rearward wall 258 of the shell to accommodate the rearward rib 248 of the magazine and correctly align the magazine with the carrier.

The assembly further includes a latch mechanism 260 having a housing 262 that is mounted to the outer side wall 264 of the shell 252 by screws 266. As will be described in greater detail below, an actuating rod 268 at one end of the mechanism 260 operates a spring-biased latch block that extends through an opening in side wall 264 so as to engage the cooperating notch in the side of the magazine. The actuating rod includes an outer end 270 that when depressed draws the latch block outwardly so as to release the magazine from the carrier, the outer end 270 of the lever extending around the rear corner of the shell for ease of access/operation by the user and being protected from damage or accidental actuation by an overhanging shelf 272 that extends from housing 262.

Figure 22:
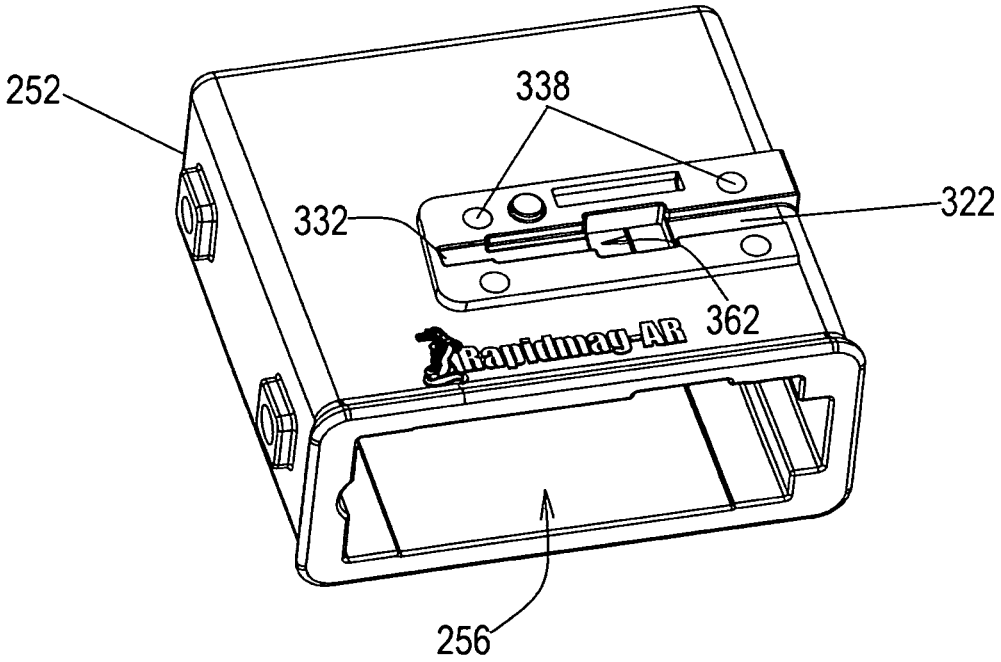
FIG. 22 is a lower perspective view of the magazine carrier of FIG. 12, showing in greater detail the structure of the housing that cooperates with the components of the magazine release assembly of FIGS. 16-21.

FIG. 16 shows in greater detail the lower rear corner of the shell 252 of the carrier assembly, that may commonly be positioned on the user's left and to the rear when worn on a belt or otherwise carried by a user. As noted above, the latch mechanism 260 includes an actuating rod 268 having an outer end 270, the latter being sized and shaped for being pressed by a finger or thumb of a user's hand. The actuator rod extends forwardly into housing 262 through a cooperating opening 320, with the inner side of the rod being received in longitudinal sliding engagement by a guide channel 322 formed in the side of the shell 252 (see FIG. 22). As can be seen in FIG. 17, which shows the latch mechanism with the cover removed, the inner end of the actuator rod, opposite outer end 270, includes an axially-extending shaft portion 326 that fits within a coil compression spring 328 so that spring 328 is compressed between the base 330 of the shaft 326 and the end 332 of channel 322. Spring 328 consequently biases the actuator rod 268 outwardly from the shell of the housing, through opening 320 in cover 262, the rod being held against escaping by abutment between a raised, outwardly-extending shoulder 334 on the rod and a cooperating stop wall (not shown) formed on the inside of the cover.

For attachment of a connector member, e.g., a belt clip, the carrier assembly 240 further includes an attachment member 274 formed by a U-shaped bracket 276, that extends across the side of the shell opposite the latch mechanism and includes first and second flange portions 278 that are mounted to the end walls of the shell by coaxially aligned screws 280. The screws are threadingly receivable in one of upper and lower sets of inserts 282 installed in the ends of the carrier shell, so that the U-shaped bracket is mountable in upper and lower positions. A slot opening 284, defined by a parallel wall spaced outwardly from the main rearward wall 286 of the U-shaped bracket, receives and engages the extension portions of a connector member, in the manner described above. For example, the connector member in FIG. 12 is a belt clip 290 having a clip portion 292 and downwardly extending front wall 294, with an extension portion and locking tooth on the latter that cooperate with slot in a manner similar to that described above.

Figure 13:
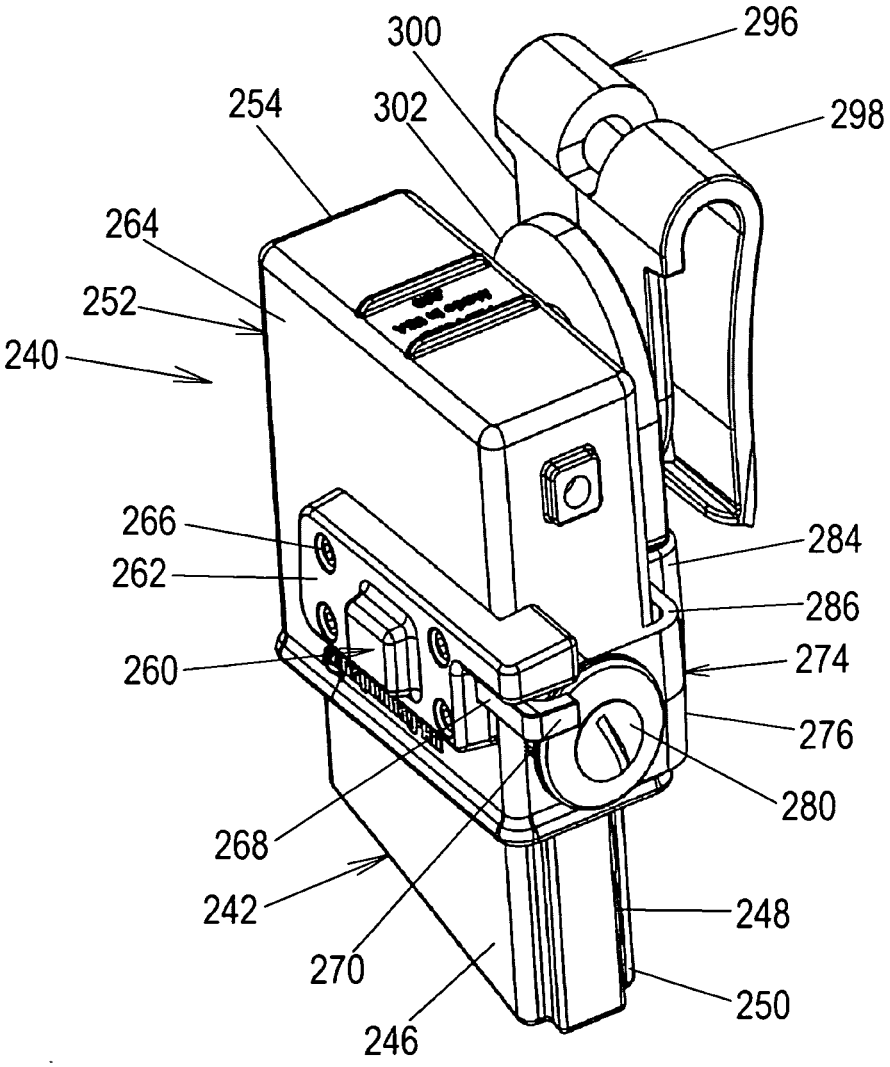
FIG. 13 is a second perspective view of the magazine carrier of FIG. 12, showing the carrier fitted with a rotatable belt-clip connector member that permits a user to pivot the carrier relative to a belt.

FIG. 13 shows another example connector member 296 that similarly includes a belt clip 298, in which the front wall 300 of the clip is rotatably mounted to a vertical flange that in turn includes the extension portion and locking feature that and cooperate with the slot 284 in the U-shaped bracket 276 of the attachment member. The pivotable connection enables a user to pivot the carrier body and magazine forwardly or rearwardly in the general plane of the belt, to such an angle as may be desired for convenient actuation of the latch mechanism and/or removal/insertion of the magazine.

Figure 14:
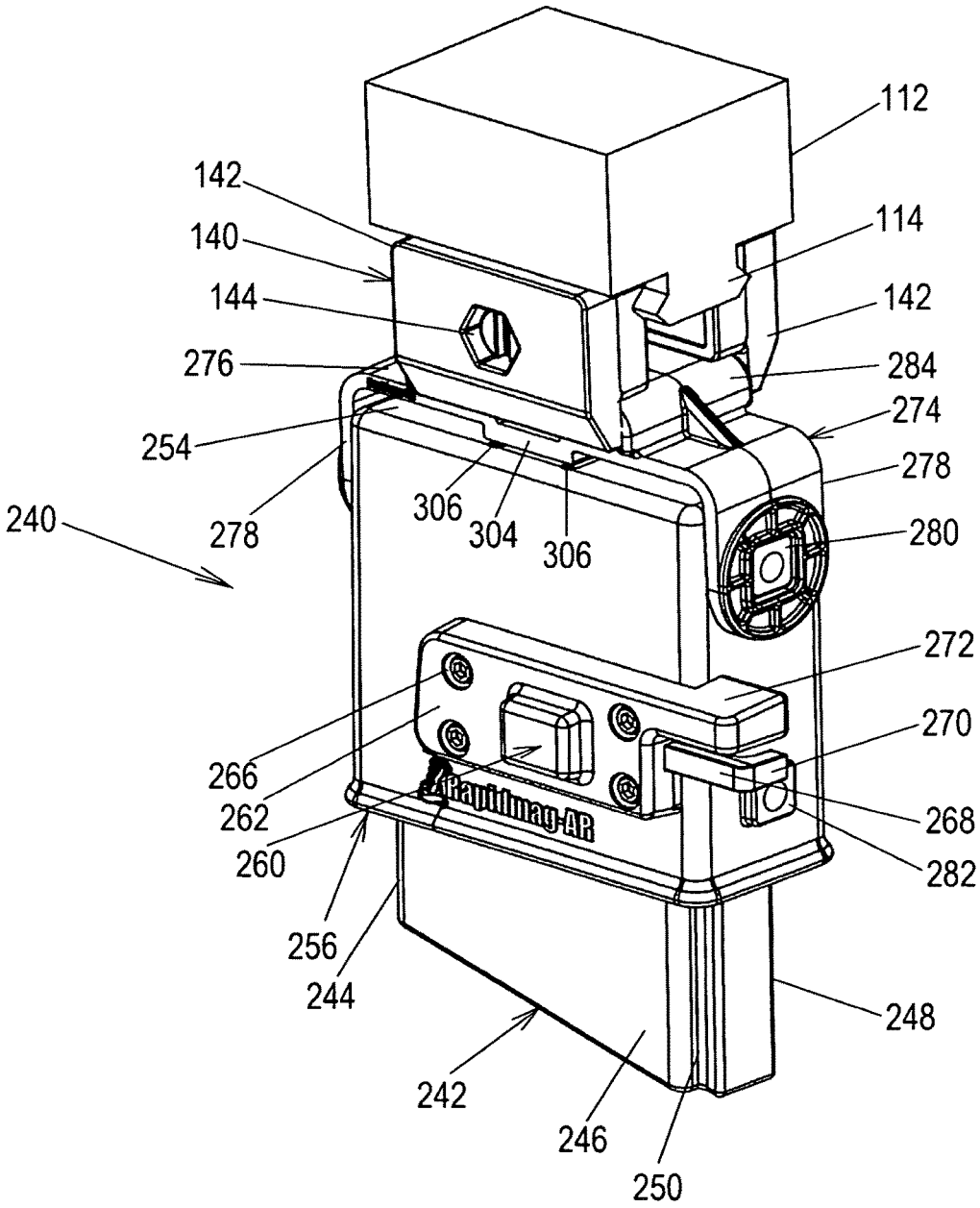
FIG. 14 is a perspective view of the magazine carrier of FIG. 12, fitted with an accessory rail connector member mounted to an example accessory rail in an in-line orientation relative thereto.
Figure 15:
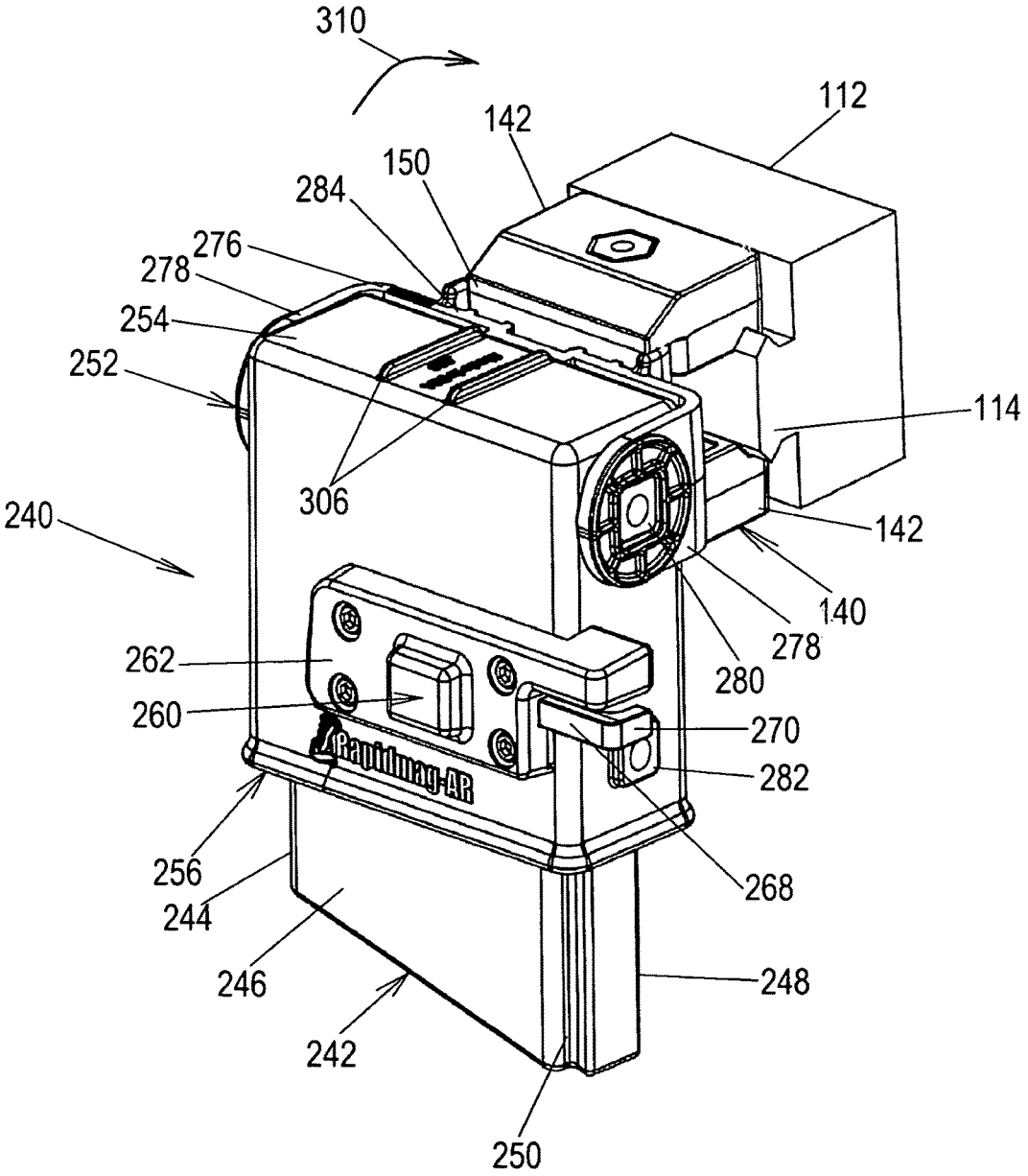
FIG. 15 is a second perspective view of the magazine carrier and accessory rail connector member mounted to an example accessory rail, showing the magazine pivoted to a right-angle orientation relative to the accessory rail.

FIGS. 14-15 show the carrier assembly 240 employed with the accessory rail connector member 140 described above with reference to FIGS. 7-8. In this configuration, the U-shaped bracket 276 of the attachment member 274 is mounted by the screws to the upper set of threaded inserts 282 so as to extend over the top wall 254 of the carrier shell. An inset portion 304 in a middle area of the U-shaped bracket bears against raised ribs 306 on the top wall 254 of the magazine shell so as to stabilize the orientation between the connector member and the shell. The connector member 140 is in turn mounted to the attachment member 274 in a manner similar to that described above, by inserting the two inwardly extending flange portions 150 in opposite ends of the mounting slot 284. The jaw portions of the two clamp pieces 142 are then slipped over the rail 114 and bolt 144 tightened to clamp the pieces firmly together.

FIG. 15 shows the carrier assembly 240 with attachment member 274 rotated 90°, as indicated by arrow 310, and clamped to a horizontally extending accessory rail 112 using the connector member 140. In this position, the inset portion 304 of the U-shaped bracket bears against the rearward side wall of shell 252 to stabilize the assembly and maintain the right-angle orientation. In this configuration the assembly may be carried on side-mounted accessory rail of a rifle or other article.

As can be seen with further reference to FIG. 17 and also FIG. 18, the middle portion 335 of the actuator rod includes a ramp face 336, having a slope that increases generally from proximate base 330 towards shoulder 334.

The middle portion of the actuator rod having the ramp face passes through a cooperating passage 340 formed in a latch block 342. The passage includes an angled outer wall 344 having a slope that generally corresponds to the sloped face 336 of the actuator rod, and an opposite, inner wall 346 that is spaced away from the outer wall so as to form a gap with the flat side of the actuator rod opposite sloped face 336.

The angled inside wall 344 of the latch block is held in sliding contact with the sloped surface 336 of the actuator rod by a coil compression spring 350 having one end that is seated around a locating peg 352 on the outer end of the block and a second end that bears against the inside wall (not shown) of a recess within a blister 356 formed in cover 262. The inner end 358 of the latch block, opposite spring 350, in turn includes a catch peg 360 that projects through an opening 362 (see FIG. 18) in the wall of the carrier shell so as to engage the catch opening 251 of the magazine, and a shoulder 362 on the sides of the catch peg that act as stops against the edges of opening 362.

Figure 21:
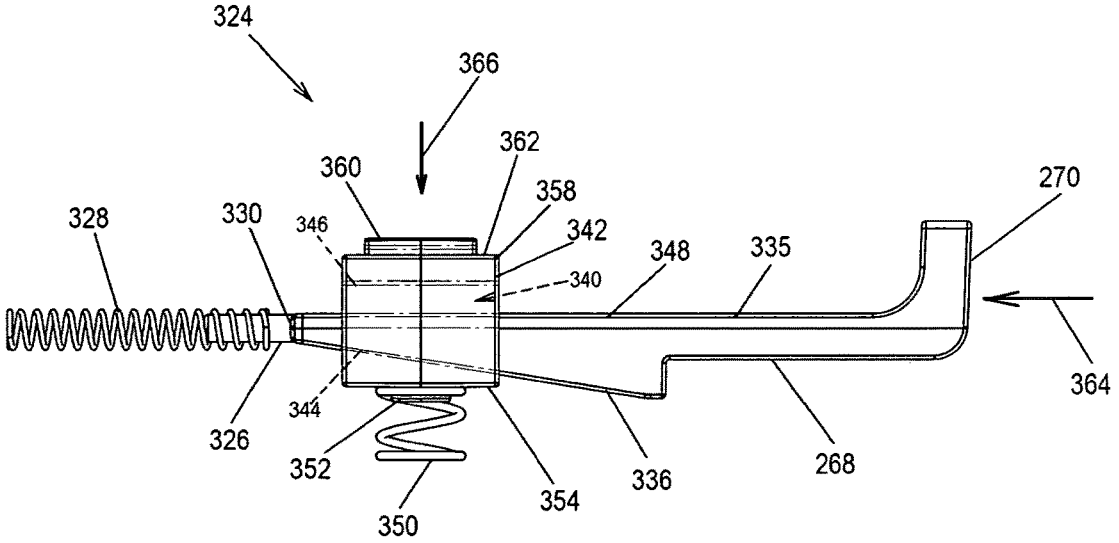
FIG. 21 is a second top, plan view of the plunger, springs and magazine catch of FIG. 20, FIG. 21 being partially ghosted to illustrate the manner in which the components cooperate in use.

Accordingly, when the actuator rod 268 is pressed into the case so as to compress spring 328, as indicated by arrow 364 in FIG. 21, the sloped face 336 on the middle portion 335 of the rod rides over the cooperating wall 344 of the passage 340 in the catch block 342, forcing the block outwardly against spring 350 in the direction indicated by arrow 366. In so doing, the latch peg 360 of the block is withdrawn from the latch opening in the magazine, releasing the latter to be removed from the shell of the carrier assembly. The recess in blister 356 in turn receives the opposite end 354 of the latch block as the latter moves in an outward direction relative to cover 262. Then, when released by the user, spring 328 returns the actuator rod to its initial extended position while spring 350 simultaneously drives the catch block 342 back towards the magazine shell so that the latch plug 360 extends through opening 362 so as to again be in position to engage the latch notch 251 of a magazine.

Figure 23:
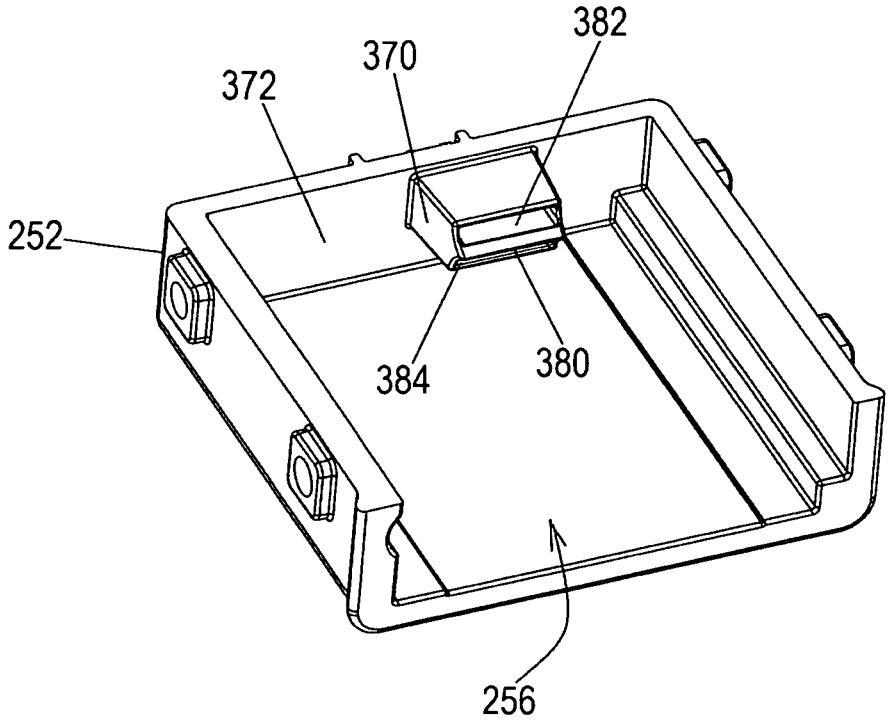
FIG. 23 is a perspective, cutaway view of the magazine carrier housing of FIG. 22, showing the interior of the housing that receives the rifle magazine and also a depending plug that extends into a feed opening of a magazine against the magazine spring so as to aid in removal of the magazine from the carrier.
Figure 24:
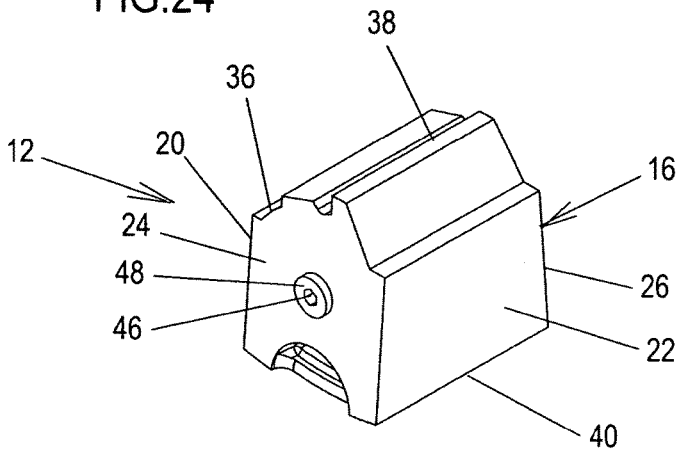
FIG. 24 is a perspective view of an example OEM-type rotary magazine for a Ruger 10/22™ rifle, such as is releasably retained in the carrier assembly as shown in FIGS. 1-11.
Figure 25:
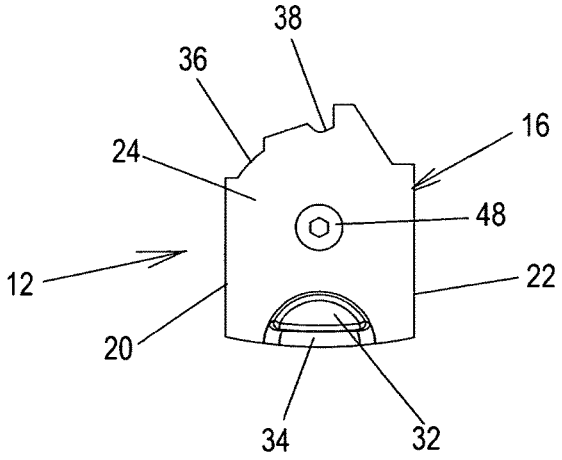
FIG. 25 is an end elevational view of the example rotary-type magazine of FIG. 24.
Figure 26:
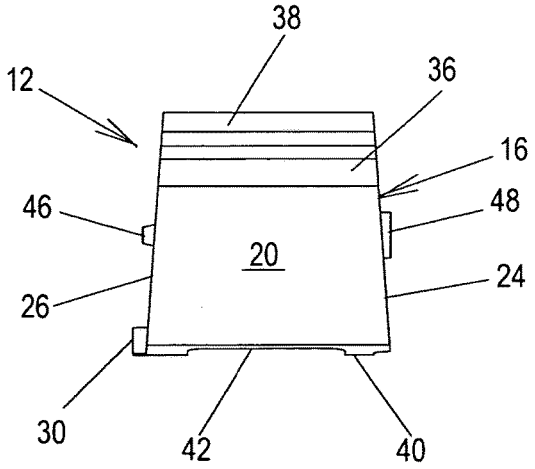
FIG. 26 is a side elevational view of the rotary-type magazine of FIG. 16, partially cut away along line 26-26 in FIG. 17, showing in greater detail the protruding end features of the axle that support the rotor of the magazine and that provide cooperating features for engagement by the carrier assembly of the present invention.

To aid in removal of the magazines the shell 252 of the carrier assembly includes a plug 370 that depends from the upper wall 372 into the interior of the shell. Plug 370 is located and dimensioned to be received between the feed lips 374 at the feed opening 376 of the magazines, so that when a magazine is inserted in the carrier housing the plug 370 causes the follower 378 to be depressed so as to compress the spring of the magazine, whether the magazine is loaded or empty. Then, when the magazine is released in the manner described above, magazine spring acts against plug 370 to help eject or "pop" the magazine out of the carrier shell. As can be seen with further reference to FIG. 23, the plug 370 includes a pointed lower edge 380 flanked by first and second concave faces 382, 384, which enables the lower end of the plug to seat firmly between the uppermost cartridges when pressed into a loaded magazine. Plug 370 is also tapered opposite the taper of the top shell casing so as to accommodate the uppermost round in the rearmost/seated position in the magazine, in order to prevent the round from "creeping" forward out of the magazine and creating the possibility of a jam.

In the illustrated embodiment the end 270 of the operating rod 260 is located at the lower rear corner of the shell of the carrier assembly, which provides the significant advantage that the user can depress the actuator rod with the thumb of the left hand while simultaneously gripping the exposed portion of the magazine with the other fingers of the hand, so that the magazines can be removed in a rapid and natural manner with reduced chance of being dropped.

It will be understood that the scope of the appended claims should not be limited by particular embodiments set forth herein, but should be construed in a manner consistent with the specification as a whole.

What is claimed is:

1. A carrier assembly for a box-type spare magazine for AR-style rifles, said carrier assembly comprising:

a carrier body, said carrier body comprising:

a shell having a bottom opening;

an interior dimensioned to receive an upper end of an AR-style rifle magazine therein;

a latching mechanism that releasably engages a catch recess formed in an outer side of said AR-style rifle magazine so as to retain said magazine in said shell of said carrier body, said latching mechanism comprising;

an actuator member mounted for longitudinal movement between extended and depressed positions generally alongside said outer side of said magazine;

a latch member mounted for lateral movement between inner and outer positions generally towards and away from said outer side of said magazine:

said latch member comprising an inner end portion that is received in said catch recess in said magazine when said latch member is in said inner position, so as to retain said magazine in said shell of said carrier body, and that is withdrawn from said catch recess in said outer side of said magazine when said latch member is in said outer position, so as to release said magazine from said shell of said carrier body; and a sloped surface on said at least one of said actuator member and said latch member, that operatively engages a cooperating face on the other of said actuator member and said latch member to force said latch member laterally from said inner position to said outer position in response to said actuator member being pressed longitudinally from said extended position to said depressed position by a user, thereby freeing said magazine for removal from said shell of said carrier assembly.

2. The carrier assembly of claim 1, wherein said actuator member comprises:

a reciprocating actuator rod that is yieldingly biased towards said extended position.

3. The carrier assembly of claim 2, wherein said latch member comprises:

a reciprocating latch piece that is yieldingly biased towards said inner position, in which said end portion of said latch member is received in said catch recess in said outer side of said magazine.

4. The carrier assembly of claim 3, wherein said sloped and cooperating faces comprise:

sloped and cooperating faces that are arranged to be biased into operative engagement by said activator rod and said latch piece.

5. The carrier assembly of claim 4, wherein said sloped face is formed on an outwardly facing surface of said actuator rod, and said cooperating face is formed on an inwardly facing surface of said latch piece.

6. The carrier assembly of claim 5, wherein said latch piece comprises:

a latch block having a passage that said actuator rod passes through, said sloped face being formed on an outwardly facing side of said actuator rod and said cooperating face being formed on an inwardly facing side of said passage through said latch block.

7. The carrier assembly of claim 2, wherein said actuator rod comprises:

a end portion protruding from said carrier body, that is engaged by a finger of a user to selectively press said actuator rod from said extended position to said depressed position.

8. The carrier assembly of claim 7, further comprising:

a fixed projection on said carrier body that protrudes adjacent said end portion of said actuator rod so as to prevent a finger of a user from accidentally pressing said end of said actuator rod.

9. The carrier assembly of claim 6, further comprising:

a compression spring that yieldingly biases said actuator rod towards said extended position, said compression spring being mounted at an enclosed end of said actuator rod opposite said end portion that is engaged by a finger of a user.

10. The carrier assembly of claim 9, further comprising:

a second compression spring that yieldingly biases said latch piece towards said inner position, said second compression spring being mounted at an enclosed end of said latch piece opposite said end portion that engages said catch recess in said magazine.

11. The carrier assembly of claim 1, wherein said shell of said carrier assembly further comprises:

a plug depending from an upper wall of said shell that is received between feed lips of said magazine in contact with a spring-loaded follower of said magazine so as to depress said follower in response to said upper end of said magazine being inserted into said lower opening of said shell, so that said spring-loaded carrier biases said magazine out of said lower opening of said shell when said magazine is freed for removal from said carrier assembly.

* * * * *